United States Patent [19]

Cave

[11] 4,127,191

[45] Nov. 28, 1978

[54] KITS FOR MAKING LATCH HOOK RUGS

[76] Inventor: Jerry K. Cave, 87 Commerce, Grant, Mich. 49327

[21] Appl. No.: 774,387

[22] Filed: Mar. 4, 1977

[51] Int. Cl.[2] ..... B65D 69/00; B65D 71/00

[52] U.S. Cl. ..... 206/574; 35/15; 289/1.5

[58] Field of Search ..... 28/147, 149; 289/1.5, 289/18; 35/15; 206/574, 575

[56] References Cited

U.S. PATENT DOCUMENTS

| | | | |
|---|---|---|---|
| 2,150,024 | 3/1939 | Clack | 28/149 |
| 2,558,386 | 6/1951 | Rabinowitz | 35/15 |
| 3,269,032 | 8/1966 | Summer | 35/15 |
| 3,621,541 | 11/1971 | Watkins | 28/149 |
| 3,783,478 | 1/1974 | Osterhout | 28/147 |
| 3,857,143 | 12/1974 | Montory et al. | 28/147 |
| 3,907,107 | 9/1975 | Vercollone | 206/574 |
| 3,970,338 | 7/1976 | Crowe | 28/149 |
| 4,032,012 | 6/1977 | Bishop | 206/574 |

*Primary Examiner*—Louis Rimrodt

*Attorney, Agent, or Firm*—Price, Heneveld, Huizenga & Cooper

[57] ABSTRACT

The specification discloses a kit for making latch hook rugs in which a hobbyist is provided with the necessary yarn, plain canvas instead of patterned canvas, and a separate pattern containing row and column grid instructions which tell the hobbyist which color yarn to put where on the plain canvas. The yarn provided is in substantial lengths which can be cut, using a provided gauge, into a plurality of shorter lengths appropriate for latch hooking.

7 Claims, 5 Drawing Figures

KITS FOR MAKING LATCH HOOK RUGS

BACKGROUND OF THE INVENTION

The present invention relates to a craft item, latch hook rugs. To make latch hook rugs, the hobbyist usually buys a kit which contains an open weave fabric or "canvas" with a colored pattern printed or painted thereon. The kit also contains short lengths (about two inches) of different colored yarns for latch hooking into the openings in the canvas according to the pattern which is printed or painted on the canvas.

These kits tend to be expensive. If the yarn were purchased separately in longer length skeins, the cost of the yarn would be much less. Also, the patterns in such kits tend to be somewhat limited because of the cost of changing the equipment necessary to print the patterns on the canvas mats.

SUMMARY OF THE INVENTION

In the present invention, the hobbyist is provided with the necessary yarn of different colors, a plain canvas instead of the usual printed canvas, and a separate pattern containing row and column grid instructions which tell the hobbyist which color yarn to place where in the openings of the canvas. As a result, many different patterns can be easily provided since they are simply printed on inexpensive sheets of paper by conventional printing means.

Preferably, yarn is provided in substantial lengths which can be cut into a plurality of shorter lengths appropriate for latch hooking. Gauge means are provided to facilitate measuring and cutting the yarn into the shorter lengths.

BRIEF DESCRIPTION OF THE DRAWINGS

These and other objects, features and advantages of the invention will be more fully understood and appreciated by reference to the written specification and drawings in which.

DESCRIPTION OF THE PREFERRED EMBODIMENT

Figure 1:
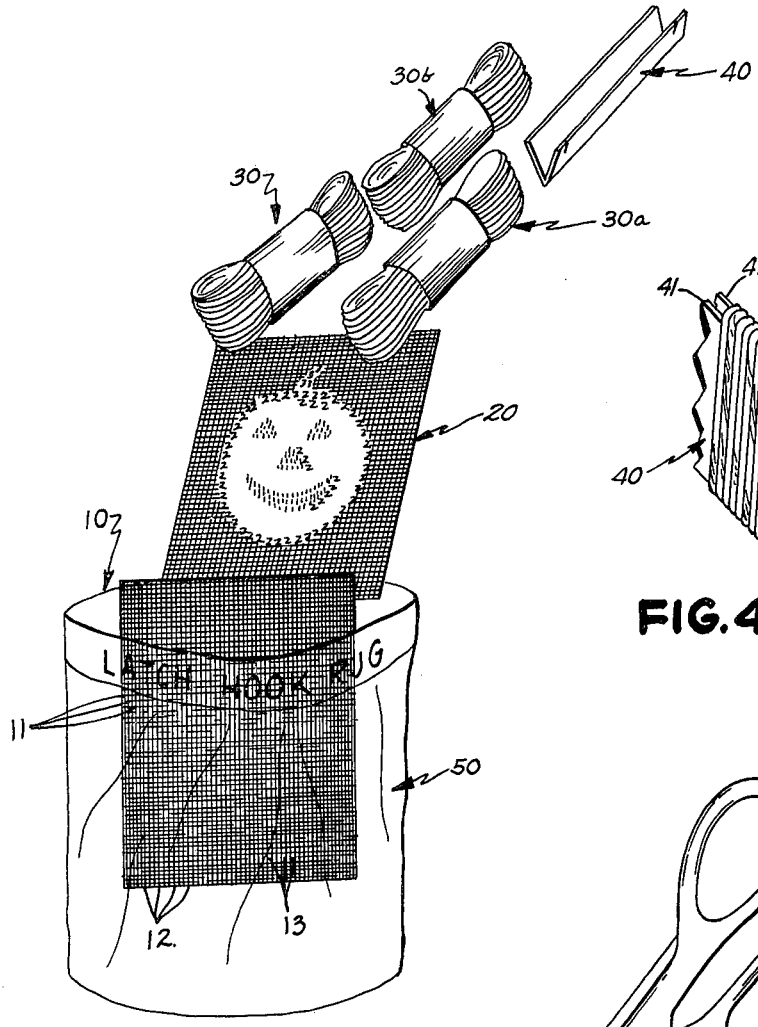
FIG. 1 is a perspective view of a container with canvas, a pattern, yarn and a gauge being shown exploded out of the container.

FIG. 1 shows the basic kit which the hobbyist is provided with in accordance with the present invention. A plastic container 50 contains a piece of plain canvas 10, a separate pattern 20, a plurality of lengths of different types of yarn, 30*a*, 30*b* and 30*c*, and a gauge 40 facilitating cutting the yarn into shorter lengths appropriate for latch hooking.

The plain canvas 10 includes a first set of generally parallel strands 11 interconnected to a second set of generally parallel strands 12, the second set of strands being generally perpendicular to the first set of strands 11. In this way, a plurality of openings or "squares" 13 are provided into which short lengths of yarn can be latch hooked.

Pattern 20 (FIG. 2) is a sheet of paper with a first set of lines 21 which correspond to the first set of strands 11 in canvas 10 and a second set of lines 22 running parallel to one another and generally perpendicular to the lines 21 which correspond to the second set of strands 12 of canvas 10. This grid of criss-crossed lines 21 and 22 define a plurality of boxes or squares 23 which correspond to the openings or "squares" 13 in canvas 10.

Figure 2:
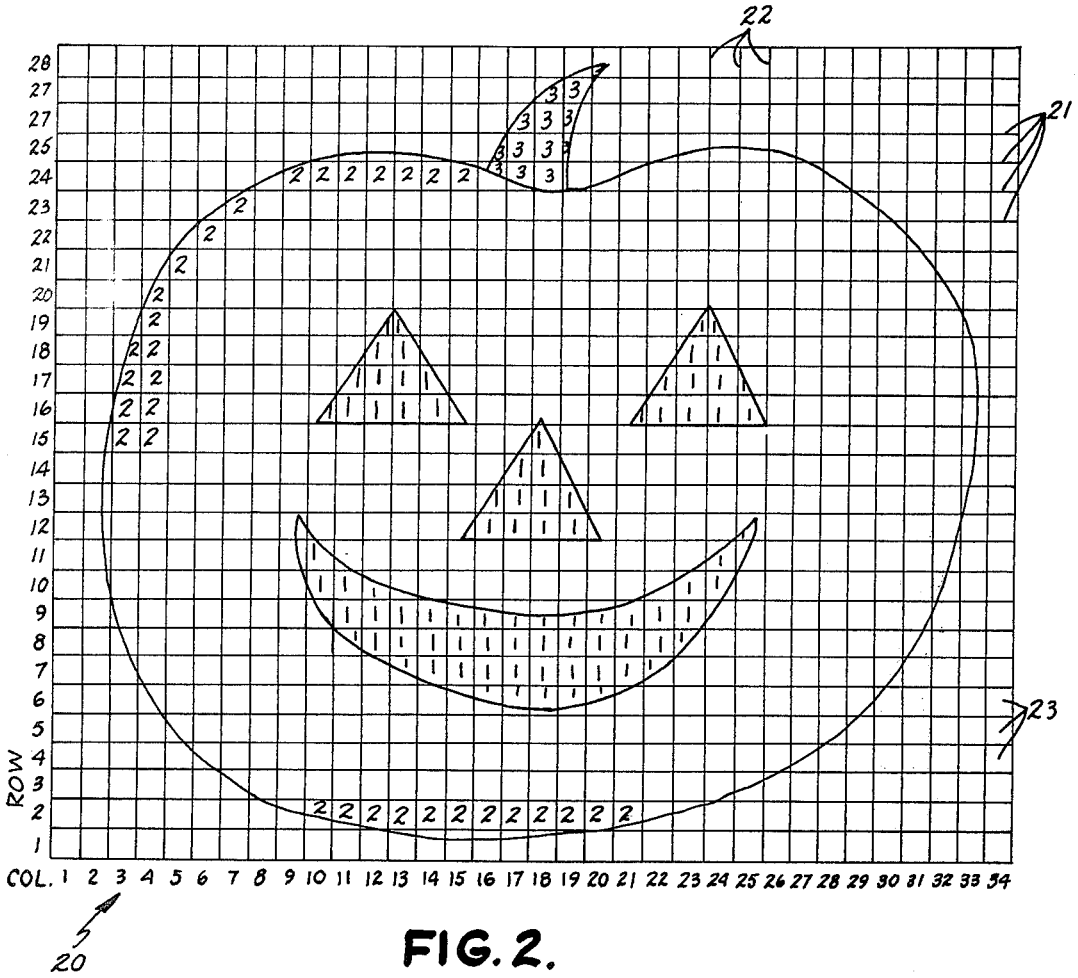
FIG. 2 is a plan view of a pattern in accordance with the present invention.

By examining FIG. 2, it can be determined that the numbers 1, 2 and 3 which appear in the squares 23 of the grid pattern define a pumpkin. The numerals 2 represent the color orange, the numerals 1 represent the color yellow and the numerals 3 represent green. (Not all the numbers 2 are shown in the drawing since the drawing is illustrative only.) There are no numbers in the remaining squares since they simply comprise a background color, probably a third color such as brown or white and the instructions given with pattern 20 would make it clear that the third color is to go into squares 13 of canvas 10 which correspond in column and row to the squares 23 in the grid of pattern 20 which contain no numbers. Similarly, the user would be told to put orange yarn in each square 13 of canvas 10 which corresponded by row and column number to a square 23 of the same row and column number in pattern 20 which contained a number 2. Finally, the hobbyist would put yellow yarn in each square 13 of canvas 10 which corresponded by row and column to a square 23 in pattern 20 which contains a number 1. As a result, a hobbyist would obtain a latch hook rug having a pattern of a pumpkin thereon.

The patterns 20 can be printed by any of a variety of different printing techniques. Once a designer has laid out a pattern on grid paper, it can be reproduced in a variety of ways.

The yarns 30*a*, 30*b* and 30*c* are three different color yarns. They are provided in skeins, probably of varying lengths according to the amount of each particular color yarn required to complete the rug in accordance with pattern 20. The yarns 30*a*, 30*b* and 30*c* are provided in rather substantial continuous lengths and are to be cut into shorter lengths appropriate for latch hooking, i.e. about 2 inches, by the hobbyist through the use of a gauge 40.

Figure 4:
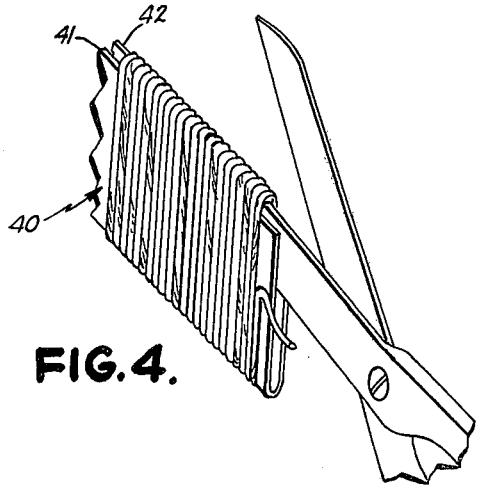
FIG. 4 is a perspective view of a gauge made in accordance with the present invention.

Gauge 40 shown in FIG. 4 includes an elongated body around which yarn is wrapped a plurality of times. That body is defined by a piece of cardboard folded in two so as to define two flaps 41 and 42 joined along a fold line 43 but defining an open edge 44 between them opposite the fold line 43 (FIGS) 1 and 4). A slot 45 extends inwardly in flap 41 and the end of the yarn can be slipped into slot 45 to hold it in place while the remainder is wrapped repeatedly around the body of gauge 40.

The open edge 44 allows one to insert some sort of cutting device into the body of gauge 40, between flaps 41 and 42, and thereby cut the yarn into a plurality of different short lengths. In FIG. 4, a scissors is shown with one blade inserted between flaps 41 and 42 and the other about to be closed so as to cut the yarn wrapped around gauge 40 into a plurality of short, probably 2 inch, lengths. If 2 inch lengths of yarn are desired, a piece of cardboard 2 inches wide is folded over to define flaps 41 and 42, each flap then being 1 inch wide.

Plastic container 50 is a conventional plastic bag and includes some form of label 51 for explanatory and/or advertising purposes.

Figure 3:
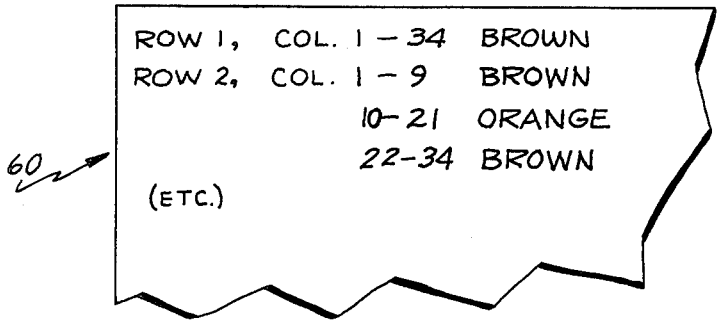
FIG. 3 is a plan view of a portion of an alternative embodiment pattern.

FIG. 3 shows an alternative embodiment pattern 60 which can be used in place of or in addition to pattern 20. Instead of including a grid work, pattern 60 includes printed instructions identifying the color of yarn which is to go into each square 13 in canvas 10, the particular square for a particular color yarn being identified by row and column. A comparison of pattern 60 of FIG. 3 with pattern 20 of FIG. 2 will show that by following either set of instructions, one would obtain the same latch hook rug.

Figure 5:
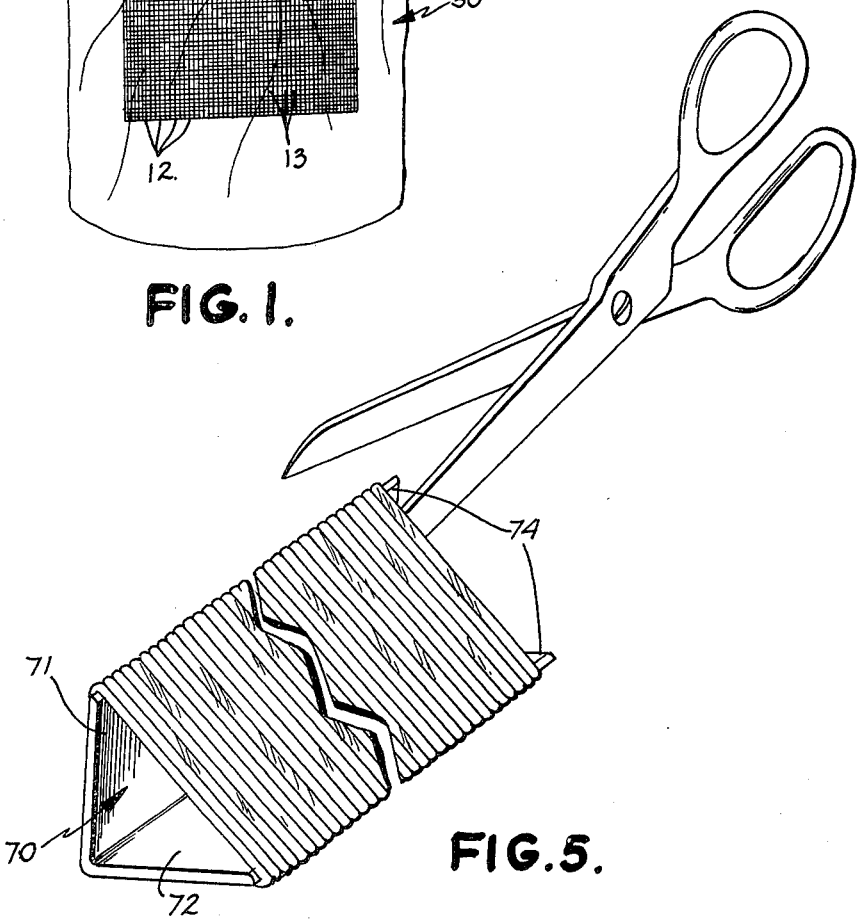
FIG. 5 is a perspective view of an alternative embodiment gauge made in accordance with the present invention.

FIG. 5 shows an alternative embodiment gauge 70 which is an angle member having legs 71 and 72 oriented at right angles to one another. There is a slot 75 extending from one edge into leg 71 for purposes of securing the end of the yarn as it is wrapped about a body of gauge 70 a plurality of times. The edges of the legs 71 and 72 are spaced to define an opening 74 which corresponds in function to the opening 44 in gauge 40. In FIG. 5, the scissors are being positioned with one blade laid along side leg 71 and with the other about to cut the yarn which is wrapped about gauge 70 into a plurality of shorter lengths. The width of legs 71 and 72 for any given short length of yarn desired would be determined in accordance with conventional trigonometric principles.

To practice the method, the hobbyist would remove canvas 10, pattern 20, yarns 30*a*, 30*b* and 30*c* and gauge 40 from the plastic container 50. A portion of one of the lengths of yarn would be wrapped spirally about gauge 40 and cut along open edge 44 so that the hobbyist would have a plurality of relatively short lengths of yarn appropriate for latch hooking.

The hobbyist would then latch hook these short lengths of yarn into canvas 10 in the squares 13 which correspond according to row and column with the squares 23 in pattern 20 in which that particular color yarn is to be latch hooked. The hobbyist continues in this manner cutting yarn and latch hooking until the rug is completed.

Of course, it is understood that the above is merely a preferred embodiment of the invention and that various changes and alterations can be made without departing from the spirit and broader aspects of the invention as set forth in the appended claims.

The embodiments of the invention in which an exclusive property or privilege is claimed are defined as follows:

1. A kit for making latch hook rugs comprising: a container; at least two different yarns contained in said container, said yarns being of continuous lengths which can be cut into a plurality of shorter lengths appropriate for latch hooking; unpatterned canvas having a plurality of first generally parallel strands joined to a plurality of second strands, said second strands being parallel to one another and generally perpendicular to said first strands to define a plurality of openings arranged in rows and columns through which yarn can be hooked and being contained in said container; a gauge for gauging longer lengths of yarn for cutting into shorter lengths of yarn appropriate for latch hooking, said gauge being contained in said container; a separate pattern including indicia identifying which yarn is to be hooked into which opening in said canvas and being contained in said container whereby a hobbyist acquiring said container and its contents can cut said yarns into shorter lengths using said gauge and can then latch hook said yarns into said canvas in accordance with said indicia on said pattern.

2. The kit of claim 1 in which said gauge includes an elongated body of uniform width and with an opening running generally the length of said body whereby said yarns can be wrapped around said body, over said elongated opening and cut along said elongated opening.

3. The kit of claim 2 in which said gauge comprises a rectangular piece of cardboard folded over into two equal flaps defined along one edge, but defining an open edge therebetween opposite said folded, joined edge, said open edge comprising said elongated opening.

4. The kit of claim 3 in which said gauge includes a slot in one of said flaps, extending inwardly from an edge thereof, through which the end of a length of yarn can be inserted and held.

5. The kit of claim 2 in which said gauge includes two legs joined to one another along one edge, but being spaced at least slightly apart along another edge to thereby define said elongated opening; one of said legs including a slot extending inwardly from an edge thereof into which the end of a length of yarn can be inserted to facilitate wrapping said yarn about said gauge.

6. The kit of claim 1 in which said indicia on said pattern comprise a grid work of spaces arranged in a plurality of numbered rows and columns corresponding to the openings in said canvas which are also arranged in a plurality of rows and columns, said spaces in said pattern containing indicia indicating the particular type of yarn to be placed in the opening in said canvas which corresponds by row and column to that particular space in said pattern.

7. The kit of claim 1 in which said indicia in said pattern comprise an identification by row and column of the openings in said canvas and an indication of what type of yarn is to be inserted into the opening as determined by said row and column in said canvas.

* * * * *